US011521790B2

(12) United States Patent
Yeo et al.

(10) Patent No.: US 11,521,790 B2
(45) Date of Patent: Dec. 6, 2022

(54) COIL COMPONENT

(71) Applicant: SAMSUNG ELECTRO-MECHANICS CO., LTD., Suwon-si (KR)

(72) Inventors: Jeong Gu Yeo, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 592 days.

(21) Appl. No.: 16/365,093

(22) Filed: Mar. 26, 2019

(65) Prior Publication Data

US 2020/0051735 A1 Feb. 13, 2020

(30) Foreign Application Priority Data

Aug. 13, 2018 (KR) ..... 10-2018-0094505

(51) Int. Cl.

| | |
|---|---|
| ***H01F 27/32*** | (2006.01) |
| ***H01F 27/28*** | (2006.01) |
| ***H01F 27/24*** | (2006.01) |
| ***H01F 27/29*** | (2006.01) |

(52) U.S. Cl.

CPC ..... *H01F 27/323* (2013.01); *H01F 27/24* (2013.01); *H01F 27/2804* (2013.01); *H01F 27/29* (2013.01); *H01F 2027/2809* (2013.01)

(58) Field of Classification Search

CPC ..... H01F 17/0013; H01F 2027/2809; H01F 17/0006; H01F 27/2804; H01F 5/003; H01F 27/29; H01F 27/292; H01F 27/24; H01F 27/323

USPC ..... 336/200, 232

See application file for complete search history.

(56) References Cited

U.S. PATENT DOCUMENTS

| | | | | |
|---|---|---|---|---|
| 10,020,112 | B2 | 7/2018 | Yoon et al. | |
| 10,854,383 | B2 | 12/2020 | Choi | |
| 2012/0274432 | A1* | 11/2012 | Jeong | H01F 17/0033 336/192 |
| 2013/0222101 | A1* | 8/2013 | Ito | H01F 3/08 336/83 |
| 2016/0086714 | A1* | 3/2016 | Moon | H01F 17/0013 336/192 |

(Continued)

FOREIGN PATENT DOCUMENTS

| | | | |
|---|---|---|---|
| CN | 105957692 | A | 9/2016 |
| CN | 106409484 | A | 2/2017 |

(Continued)

OTHER PUBLICATIONS

Chinese Office Action dated Jan. 11, 2022 , issued in corresponding Chinese Patent Application No. 201910675734.2 (with English Translation).

*Primary Examiner* — Tszfung J Chan

(74) *Attorney, Agent, or Firm* — Morgan, Lewis & Bockius LLP

(57) ABSTRACT

A coil component includes a body and external electrodes. The body includes a support member having through-openings formed in end portions thereof, an internal coil supported by the support member, and an encapsulant encapsulating the support member and the internal coil. The through-openings are filled with end portions of the internal coil. An insulating layer is interposed between the internal coil and the external electrode.

19 Claims, 3 Drawing Sheets

(56) References Cited

U.S. PATENT DOCUMENTS

| | | | | |
|---|---|---|---|---|
| 2016/0268038 | A1* | 9/2016 | Choi | H01F 27/255 |
| 2017/0032885 | A1 | 2/2017 | Lee et al. | |
| 2017/0178798 | A1* | 6/2017 | Yoon | H01F 41/041 |
| 2018/0122546 | A1 | 5/2018 | Lee et al. | |
| 2018/0137975 | A1 | 5/2018 | Cha et al. | |
| 2020/0365315 | A1* | 11/2020 | Kim | H01F 17/04 |

FOREIGN PATENT DOCUMENTS

| | | | | |
|---|---|---|---|---|
| CN | 106898479 | A | | 6/2017 |
| CN | 108010660 | A | | 5/2018 |
| JP | 2014197590 | A | * | 10/2014 |
| JP | 2015126199 | A | * | 7/2015 |
| KR | 1999-0066108 | A | | 8/1999 |
| KR | 10-1434351 | B1 | | 8/2014 |
| KR | 10-1792365 | B1 | | 11/2017 |

* cited by examiner

COIL COMPONENT

CROSS-REFERENCE TO RELATED APPLICATION(S)

This application claims benefit of priority to Korean Patent Application No. 10-2018-0094505 filed on Aug. 13, 2018 in the Korean Intellectual Property Office, the disclosure of which is incorporated herein by reference in its entirety.

TECHNICAL FIELD

The present disclosure relates to a coil component, and more particularly, to a thin-film power inductor for an electric component.

BACKGROUND

Recently, electronic components used in high-performance, high-current environments are required to be applied to mobile wireless communications devices and electric components. In detail, a component for use in an electric component generally requires stable driving characteristics and high reliability when a current higher than a current used in a smartphone is applied thereto.

SUMMARY

An aspect of the present disclosure is to provide a coil component in which a dielectric breakdown path is structurally suppressed by improving insulating properties between an external electrode and a body to implement high reliability.

According to an aspect of the present disclosure, a coil component includes a body including a support member, an internal coil supported by the support member, and an encapsulant encapsulating the support member and the internal coil, and first and second external electrodes disposed on external surfaces of the body and connected to the internal coil. The support member has a through-hole, a via hole, and through-openings spaced apart from the through-hole and the via hole and disposed on end portions of the support member, respectively. The internal coil includes a first coil disposed on one surface of the support member and a second coil disposed on the other surface of the support member. Each of the first and second coils has an end portion filling the through-opening of the support member and extending between outermost surfaces, in a thickness direction along which the first and second coils are disposed, of the first coil and the second coil. A first insulating layer is disposed on at least one surface of the body, and a second insulating layer is disposed on at least the other surface disposed to oppose the one surface of the body. The first insulating layer has one end portion extending between the end portion of the first coil and the first external electrode, and the second insulating layer has one end portion extending between the end portion of the second coil and the second external electrode.

The first insulating layer may have the other end portion extending between the second coil and the second external electrode, and the second insulating layer may have the other end portion extending between the first coil and the first external electrode.

The end portions of the support member may be spaced apart from the first and second external electrodes.

The first external electrode may be in direct contact with one of the first coil, the first insulating layer, and the second insulating layer.

The second external electrode may be in direct contact with one of the second coil, the first insulating layer, and the second insulating layer.

The encapsulant may fill the through-hole.

The encapsulant may include a material having magnetic properties.

An interval, at which the first and second insulating layers are spaced apart from each other, may be less than a thickness of the end portion of the first coil or a thickness of the end portion of the second coil.

The first external electrode may be directly connected to the first coil at a center of the end portion of the first coil.

The second external electrode may be directly connected to the second coil at a center of the end portion of the second coil.

The first and second insulating layers may be integrated into a single body by a connecting portion.

The first and second insulating layers and the connecting portion may have a cross-sectional shape including a space passing through a center thereof.

The space may be filled with the first external electrode or the second external electrode.

The space may have a cross-sectional area greater than a cross-sectional area of the end portions of the first and second coils exposed to the body.

The space may have a cross-sectional area smaller than a cross-sectional area of the end portions of the first and second coils exposed to the body.

The first and second external electrodes may be spaced apart from the encapsulant by the first and second insulating layers.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
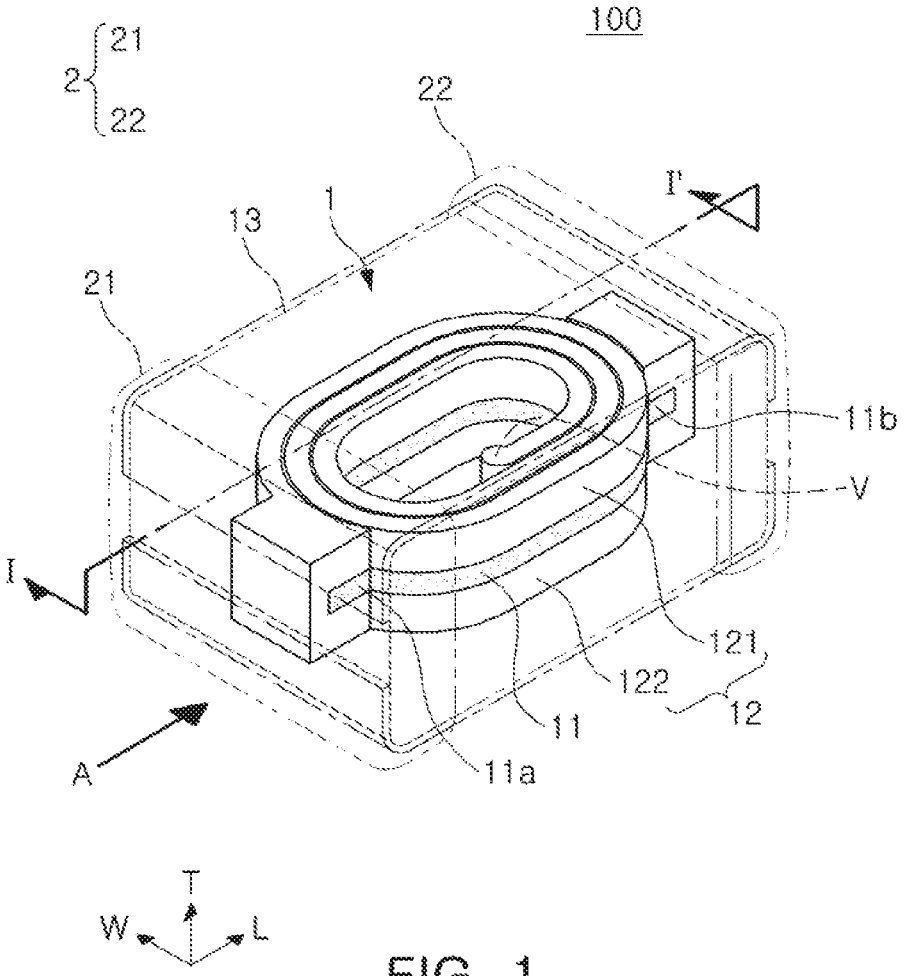
FIG. 1 is a perspective view of a coil component according to an exemplary embodiment in the present disclosure.

Hereinafter, examples of the present disclosure will be described as follows with reference to the attached drawings.

The present disclosure may, however, be embodied in many different forms and should not be construed as limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

Hereinafter, a coil component according to an exemplary embodiment in the present disclosure will be described, but is not necessarily limited thereto.

Figure 2:
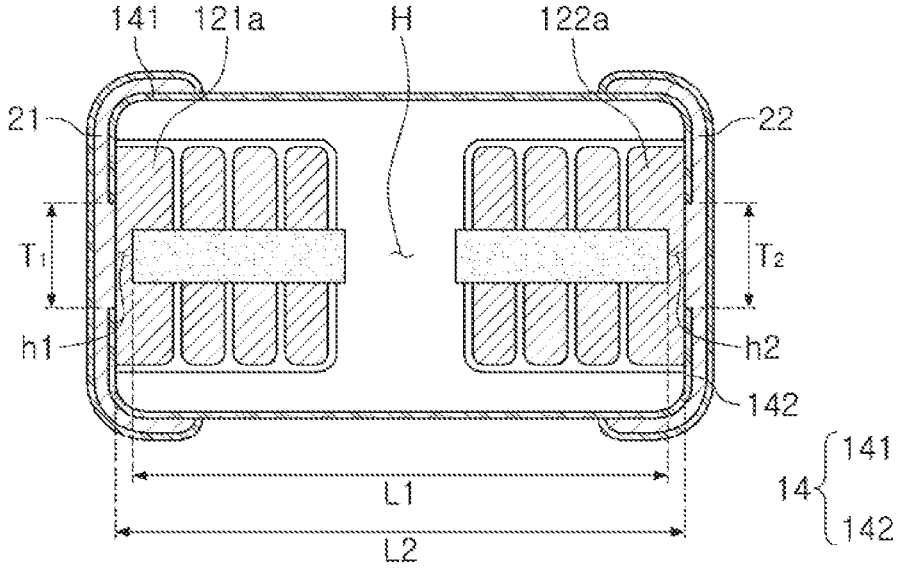
FIG. 2 is a cross-sectional view taken along line I-I' in FIG. 1.

FIG. 1 is a perspective view of a coil component 100 according to an exemplary embodiment in the present disclosure. FIG. 2 is a cross-sectional view taken along line I-I' in FIG. 1, and FIG. 3 is a cross-sectional view taken in direction A in FIG. 1.

Figure 3:
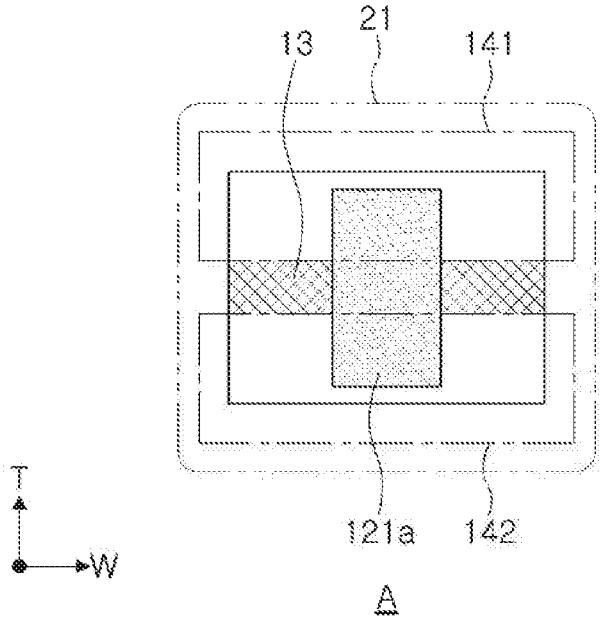
FIG. 3 is a cross-sectional view taken in direction A in FIG. 1.

Referring to FIGS. 1 to 3, the coil component 100 includes a body 1 and external electrodes 2 disposed on external surfaces of the body 1.

The external electrodes 2 includes a first external electrode 21, disposed on an external surface of the body 1 to be directly connected to a first coil, and a second external coil 22 disposed on an external surface of the body 1 to directly connected to a second coil. Each of the first and second external electrodes 21 and 22 may be formed of a material having improved conductivity, and may have a multilayer structure, as needed. In this case, at least one of the external electrodes 21 and 22 may include a nickel (Ni) layer, a tin (Sn) layer, or a silver-epoxy (Ag-epoxy) layer as a conductive resin layer.

In FIG. 1, the first and second external electrodes 21 and 22 are represented by an alphabet letter C, but a shape thereof may be appropriately designed and changed by those skilled in the art. For example, the first and second external electrodes 21 and 22 may be L-shaped electrodes covering only two sides of the body 1, or be bottom electrodes including both first and second external electrodes formed on one side of the body 1, but are not limited thereto.

The body 1 substantially determines an appearance of the coil component 100. The body 1 has a substantially hexahedral shape having a top surface and a bottom surface opposing each other in a thickness direction T, a first end surface and a second end surface opposing each other in a length direction L, and a first side surface and a second side surface opposing each other in a width direction W.

The body 1 includes an internal coil 12, a support member 11 supporting the internal coil 12, and an encapsulant 13 encapsulating the support member 11 and the internal coil 12.

The support member 11 has rigidity suitable to support the internal coil 12, and has a plate shape to facilitate formation of the internal coil 12. The support member 11 may be applied without limitation as long as it has an insulating properties. The support member 11 may have a shape in which an additive for rigidity such as a glass frit or a magnetic particle for magnetic properties is dispersed in an ingredient of an insulating material. Specifically, the support member 11 may be a copper clad laminate (CCL) substrate well known in the art, but is not limited thereto.

Both end portions 11*a* and 11*b* of the support member 11 are configured not to be direct contact with the external electrodes 21 and 22. For example, the end portions 11*a* and 11*b* of the support member 11 are spaced apart from the external electrodes 21 and 22. Thus, a length L1 of the support member 11 extending in the length direction is less than a length L2 of the body 1. A method of removing both the end portions of the support member 11 is not limited, and drilling or laser machining may be applied without limitation.

Predetermined through-openings h1 and h2 are formed in portions where both the end portions of the support member 11 are removed, respectively. The through-openings h1 and h2 are filled with internal coils.

In addition to the through-openings h1 and h2, the support member 11 includes a through-hole H in a center thereof and a via hole v spaced apart from the through-hole H. The through-openings h1 and h2 are filled with internal coils, while the through-hole H is filled with an encapsulant. The via hole v is filled with an internal coil in the same manner as the through-openings h1 and h2.

The internal coil 12 is supported by the support member 11, and includes a first coil 121 disposed on one surface of the support member 11 and a second coil 122 disposed on the other surface of the support member 11. When viewed from above, the first and second coils 121 and 122 have a spiral shape. The first and second coils 121 and 122 are electrically connected to each other by an internal coil, for example, a via, filling the via hole.

One end portion of the first coil 121 is connected to the via connected to the second coil 122, while the other end portion 121*a* of the first coil 121 is connected to the first external electrode 21. Similarly, one end portion of the second coil 122 is connected to the via connected to the first coil 121, while the other end portion 122*a* is connected to the second external electrode 22.

The other end portions 121*a* and 122*a* of the first and second coils 121 and 122 may extend in the thickness direction while filling the through-openings h1 and h2 passing through the support member 11. As a result, a contact area between the first coil 121 and the first external electrode 21, and a contact area between the second coil 122 and the second external electrode 22 are increased to provide stable electrical conductivity between the internal coil and the external electrode. The other end portion 121*a* of the first coil 121 extends to a position of an uppermost surface of the second coil 122, and the other end portion 122*a* of the second coil 122 extends to a position of an uppermost surface of the first coil 121. A contact between the internal coil and the external electrode may be significantly improved by increasing lengths of the other end portions of the first and second coils 121 and 122. In further detail, the other end portions 121*a* and 122*a* of the first and second coils 121 and 122 extend to positions of the uppermost surfaces of the second and first coils 122 and 121, but the extension thereof is not limited thereto. It is a matter of course that both end portions of the first and second coils 121 and 122 should be included as an exemplary embodiment in the present disclosure as long as both the end portions fill a through-hole and extend substantially by a predetermined thickness in a direction away from the support member 11 to substantially implement the effect.

In the case in which the other end portions of the first and second coils 121 and 122 extend to positions of the uppermost surfaces of the second coil and the first coil 122 and 121, respectively, a probability that the end portion of the internal coil will be appropriately exposed during a process may be significantly increased when the insulating layer 14 is processed. Specifically, in the case in which the length of the other end portion of each of the first and second coils 121 and 122 is substantially the same as a thickness of the body of the first and second coils, the other end portions of the first and second coils 121 and 122 may not be exposed according to a process error or a condition of a product design environment even when the other end portions of the first and second coils 121 and 122 are desired to be exposed by processing the insulating layer 14. Thus, poor connections between the internal coil and the external electrode may occur. However, in the case of the present disclosure, thicknesses of the other end portions of the first and second coils 121 and 122 are increased to substantially twice the thicknesses of the first and second coils 121 and 122, to increase the probability that the end portions of the first and second coils 121 and 122 are exposed when the insulating layer is processed and to reduce poor contact between the internal coil and the external electrode.

The other end portion 121*a* of the first coil 121 is directly connected to the first external electrode 21 at the center of the other end portion of the first coil 121, and the other end portion 122*a* of the second coil 122 is directly connected to the second external electrode 122 at the center of the other end portion of the second coil 122. As described above, since the external electrode and the end portion of the coil are directly connected to each other at the center of the end portion of the coil, reliability of connectivity between the coil and the external electrode may be improved.

The other end portions 121*a* and 122*a* of the first and second coils 121 and 122 are connected to the first and second external electrodes 21 and 22. In this case, first and second insulating layers 141 and 142 are disposed on at least a portion between the first and second external electrodes 21 and 22. Since the first and second insulating layers 141 and 142 are formed by extending an insulating layer insulating the body 1, the first insulating layer 141 also covers a top surface of the body 1, and the second insulating layer 142 also covers a bottom surface of the body 1. Although not shown, the first insulating layer 141 and the second insulating layer 142 may be connected to each other on the first and second side surfaces in the width direction Wand cover the first and second side surfaces in the width direction W.

The first and second insulating layers 141 and 142 may include a polymeric resin such as epoxy or perylene, or ceramic such as alumina or silica. At least one of materials having insulation properties may be appropriately selected by those skilled in the art.

Figure 4:
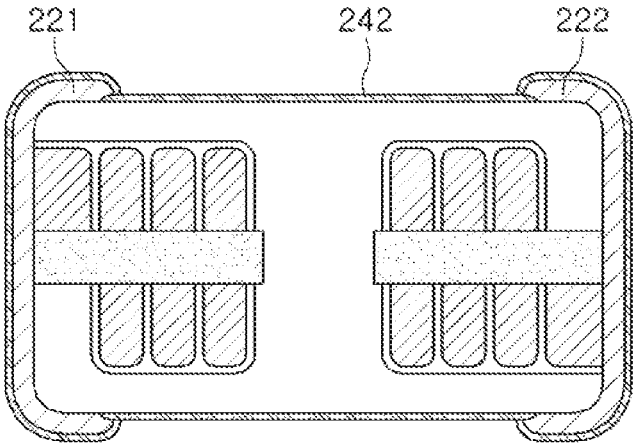
FIG. 4 is a cross-sectional view of a related-art coil component.

The first and second insulating layers 141 and 142 are disposed in consideration of a dielectric breakdown path of the coil component. Referring to FIG. 4, which is a cross-sectional view of a related-art coil component, to inspect such a dielectric breakdown path, an insulating layer 242 insulating a body is disposed only on top and bottom surfaces of the body to prevent a plating liquid from permeating into end portions of the first and second external electrodes 221 and 222. Alternatively, the insulating layer 242 may extend to an extent that the insulating layer 242 covers a corner of the top or bottom surface of body (not shown). However, such an insulating layer does not extend to a region in which an internal coil and an external electrode are in contact with each other. This is because when the insulating layer of the body is polished to expose an end portion of the internal coil, it is common that all insulating layers on first and second end surfaces of the body are almost removed. In such a polishing process, an encapsulant of the body is damaged and an end portion of the insulating layer around the damaged portion forms a dielectric breakdown path to significantly degrade reliability of the coil component.

The coil component 100 illustrated in FIGS. 1 to 3 allows a related-art mechanical polishing process to be omitted by significantly increasing an exposed end surfaces of both end portions of the first and second coils 121 and 122 in order to prevent vulnerability of reliability. Instead of the mechanical polishing process, laser machining or sandblasting is undertaken to expose both end portions of the first and second coils even when the first and second insulating layers are slightly removed. The laser machining may be appropriately set by those skilled in the art, but laser machining using, for example, a Paloma-type aligner may be selected.

Since only portions of the first and second insulating layers applied with the end portions of the first and second coils are removed while the other portions remain in a chip, unnecessary loss of the encapsulant in the body is prevented and the dielectric breakdown path is removed. Therefore, insulating reliability of the coil component may be improved.

Each of intervals T1 and T2, at which the first and second insulating layers are spaced apart from each other, is less than a thickness of the other end portion 121*a* of the first coil 121 and a thickness of the other end portion 122*a* of the second coil 122. Accordingly, there is no surface, brought into direct contact with internal surfaces of the first and second external electrodes 21 and 22, among external surfaces of the body without the interposition of the first and second insulating layers 141 and 142. That is, the first and second external electrodes 21 and 22 are spaced apart from the encapsulant 13 of the body 1 by the first and second insulating layers 141 and 142. As a result, insulating reliability may be improved.

Figure 5:
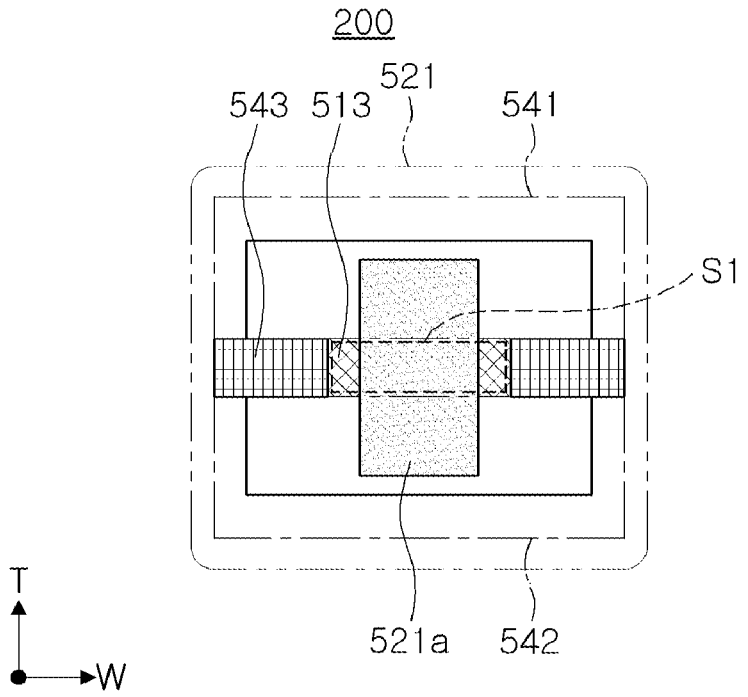
FIG. 5 is a cross-sectional view for a surface corresponding to direction A in FIG. 1, in a coil component according to a modified embodiment of the coil component in FIG. 1.

FIG. 5 is a cross-sectional view for a surface corresponding to direction A in FIG. 1, in a coil component 200 according to a modified embodiment of the coil component 100 in FIG. 1. The surface corresponding to the direction A is a surface on which a first external electrode 521 is disposed. Since a surface, on which a second external electrode is disposed, is symmetrical to the surface corresponding to the direction A on the basis of a length direction, an explanation of a surface opposing the surface corresponding to the direction A will be omitted.

Referring to FIG. 5, the coil component 200 further includes a connecting portion 543 connecting a first insulating layer 541 and a second insulating layer 542 to each other.

Although the first and second insulating layers 541 and 542 and the connecting portion 543 are illustrated in FIG. 5 as separate components for ease of description, the first and second insulating layers 541 and 542 and the connecting portion 543 are connected to each other such that boundaries therebetween may not be readily apparent or the first and second insulating layers 541 and 542 and the connecting portion 543 are integrally formed as one piece. To this end, after an insulating layer is disposed to cover the entire first end surface, a central portion of the insulating layer may be laser-machined to expose an end portion of a first coil, but processing thereof is not limited thereto.

Referring to FIG. 5, the first and second insulating layers 541 and 542 and the connecting portion 543 have a cross-sectional shape including a space S1 passing through a center thereof. The space S1 refers to a region removed from the insulating layer, disposed to cover the entire first end surface, by laser machining or the like.

A dimension of the space S1 in a width direction is greater than a dimension of the end portion 521*a* of the first coil in the width direction. As a result, an internal side surface of the first external electrode 521, disposed on the first end surface to be in contact with the end portion 521*a* of the first coil, is also in contact with an encapsulant 513 exposed by the space S1.

A shape of the space S1 may be variously modified into a rectangle as well as a circle, an ellipse, a square, or the like, and a shape and a size of a cross section thereof may be set, as need by those skilled in the art.

Figure 6:
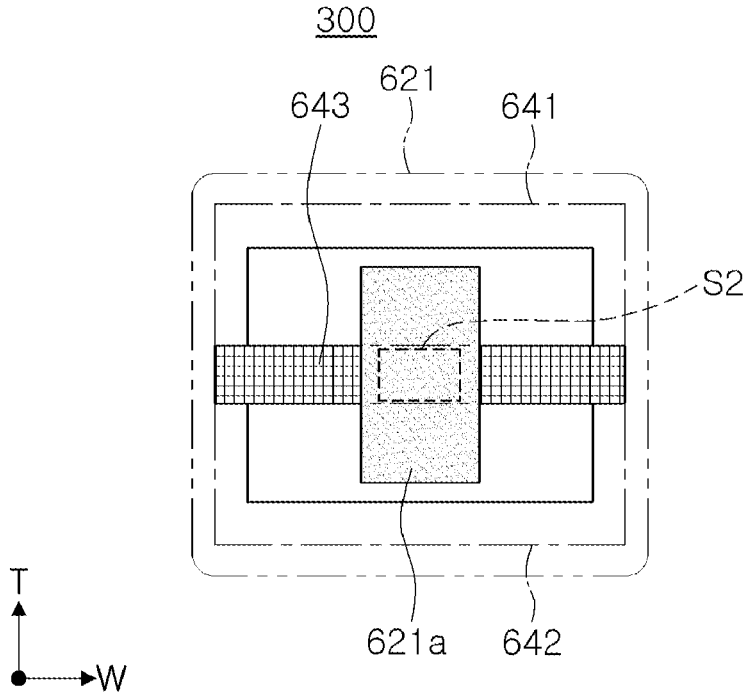
FIG. 6 is a cross-sectional view for a surface corresponding to direction A in FIG. 1, in a coil component according to another modified embodiment of the coil component in FIG. 1.

FIG. 6 is a cross-sectional view for a surface corresponding to direction A in FIG. 1, in a coil component 300 according to another modified embodiment of the coil component 100 in FIG. 1.

FIG. 6 shows a space S2 having a size different from a size of the space S1 shown in FIG. 5, and includes substantially duplicate contents.

Referring to FIG. 6, a dimension of the space S2 extending in a width direction on a first end surface is less than a dimension of an end portion 621*a* of a first coil, exposed to the first end surface, extending in the width direction. As a result, at least a portion of the end portion 621*a* of the first coil is covered with a first insulating layer 641 or a second insulating layer 642.

The end portion 621*a* of the first coil may be exposed by the space S2 to be electrically connected to a first external electrode 621.

Since the space S2 has a relatively small size, a contact area between the first external electrode 621 and the end portion 621*a* of the first coil may be reduced, but contact reliability and insulating properties may be improved.

As described above, one of various effects of the present disclosure is to provide a coil component having improved contact between an external electrode and an internal coil and improved insulating properties between an external electrode and a body.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member, an internal coil supported by the support member, and an encapsulant configured to encapsulate the support member and the internal coil; and first and second external electrodes disposed on external surfaces of the body and connected to the internal coil, wherein the support member has a through-hole, a via hole, and through-openings spaced apart from the through-hole and the via hole and disposed on end portions of the support member, respectively, the internal coil includes a first coil disposed on one surface of the support member and a second coil disposed on another surface of the support member, the first and second coils have end portions filling the through-openings, respectively, of the support member and extending between outermost surfaces, in a thickness direction along which the first and second coils are disposed, of the first coil and the second coil, a first insulating layer is disposed on at least one surface of the body, and a second insulating layer is disposed on at least another surface opposing the one surface of the body, and the first insulating layer has one end portion extending between the end portion of the first coil and the first external electrode in a direction perpendicular to the thickness direction, and the second insulating layer has one end portion extending between the end portion of the second coil and the second external electrode in the direction perpendicular to the thickness direction.

2. The coil component of claim 1, wherein the first insulating layer has another end portion, extending between the second coil and the second external electrode, and the second insulating layer has another end portion extending between the first coil and the first external electrode.

3. The coil component of claim 1, wherein the end portions of the support member are spaced apart from the first and second external electrodes.

4. The coil component of claim 1, wherein the first external electrode is in direct contact with one of the first coil, the first insulating layer, and the second insulating layer.

5. The coil component of claim 1, wherein the second external electrode is in direct contact with one of the second coil, the first insulating layer, and the second insulating layer.

6. The coil component of claim 1, wherein the encapsulant fills the through-hole.

7. The coil component of claim 1, wherein the encapsulant includes a material having magnetic properties.

8. The coil component of claim 1, wherein an interval, at which the first and second insulating layers are spaced apart from each other, is less than a thickness of the end portion of the first coil or a thickness of the end portion of the second coil.

9. The coil component of claim 1, wherein the first external electrode is directly connected to the first coil at a center of the end portion of the first coil.

10. The coil component of claim 1, wherein the second external electrode is directly connected to the second coil at a center of the end portion of the second coil.

11. The coil component of claim 1, wherein the first and second insulating layers are integrated into a single body by a connecting portion.

12. The coil component of claim 11, wherein the first and second insulating layers and the connecting portion have a cross-sectional shape including a space passing through a center thereof.

13. The coil component of claim 12, wherein the space is filled with the first external electrode or the second external electrode.

14. The coil component of claim 12, wherein a dimension of the space in a width direction is greater than a dimension of the end portions of the first and second coils exposed to the body in the width direction.

15. The coil component of claim 12, wherein a dimension of the space in a width direction is smaller than a dimension of the end portions of the first and second coils exposed to the body in the width direction.

16. The coil component of claim 1, wherein the first and second external electrodes are spaced apart from the encapsulant by the first and second insulating layers.

17. The coil component of claim 1, wherein the one end portion of the first insulating layer directly contacts the end portion of the first coil, and the one end portion of the second insulating layer directly contacts the end portion of the second coil.

18. A coil component comprising:

a body including a support member, an internal coil supported by the support member, and an encapsulant configured to encapsulate the support member and the internal coil; and first and second external electrodes disposed on external surfaces of the body and connected to the internal coil, wherein the support member has a through-hole, a via hole, and through-openings spaced apart from the through-hole and the via hole and disposed on end portions of the support member, respectively, the internal coil includes a first coil disposed on one surface of the support member and a second coil disposed on another surface of the support member, the first and second coils have end portions filling the through-openings, respectively, of the support member and extending between outermost surfaces, in a thickness direction along which the first and second coils are disposed, of the first coil and the second coil, such that the end portions of the first and second coils extend beyond both the one surface and the another surface of the support member in the thickness direction and are exposed from respective external surfaces of the body from above the one surface to below the another surface of the support member, a first insulating layer is disposed on at least one surface of the body, and a second insulating layer is disposed on at least another surface opposing the one surface of the body, and the first insulating layer has one end portion extending between the end portion of the first coil and the first external electrode in a direction perpendicular to the thickness direction, and the second insulating layer has one end portion extending between the end portion of the second coil and the second external electrode in the direction perpendicular to the thickness direction.

19. The coil component of claim 18, wherein the one end portion of the first insulating layer directly contacts the end portion of the first coil, and the one end portion of the second insulating layer directly contacts the end portion of the second coil.

* * * * *